US005213049A

United States Patent [19]

Kobayashi

[11] Patent Number: 5,213,049

[45] Date of Patent: May 25, 1993

[54] RAILWAY VEHICLE BOGIE

[75] Inventor: Noboru Kobayashi, Kobe, Japan

[73] Assignee: Kawasaki Jukogyo Kabushiki Kaisha, Kobe, Japan

[21] Appl. No.: 735,723

[22] Filed: Jul. 25, 1991

[30] Foreign Application Priority Data

Jul. 30, 1990 [JP] Japan ..... 2-203588
Jul. 30, 1990 [JP] Japan ..... 2-203589

[51] Int. Cl.[5] ..... B61F 5/44
[52] U.S. Cl. ..... 105/168; 105/199.1
[58] Field of Search ..... 105/168, 171, 185, 190.1, 105/199.1, 167, 182.1

[56] References Cited

U.S. PATENT DOCUMENTS 4,170,179 10/1979 Vogel ..... 105/199.1
4,660,476 4/1987 Franz ..... 105/182.1
4,679,506 7/1987 Goding et al. ..... 105/168
4,735,149 4/1988 Scheffel et al. ..... 105/167

FOREIGN PATENT DOCUMENTS 0357951 3/1990 European Pat. Off. .
3047916 9/1981 Fed. Rep. of Germany .
61-24125 10/1986 Japan .
64-10458 1/1989 Japan .
64-11880 1/1989 Japan .
90/02068 3/1990 PCT Int'l Appl. .
464379 4/1937 United Kingdom .

*Primary Examiner*—Robert J. Oberleitner
*Assistant Examiner*—Kevin D. Rutherford
*Attorney, Agent, or Firm*—Schwartz & Weinrieb

[57] ABSTRACT

A railway vehicle bogie has a pair of levers and twos pairs of links driven by the pair of levers so as to swivel axles. The front and rear axle boxes are spaced longitudinally of the bogie frame and are angularly displaceably mounted at the centers thereof to the bogie frame. The axle boxes carry a vehicle body thereon and support axles therein. First links are angularly displaceably connected to the front axle box while second links are angularly displaceably connected to the rear axle box. A pair of levers are spacedly disposed transversely of the bogie frame and angularly displaceably connected at their intermediate portions to the bogie frame. One of the levers is angularly and displaceably connected to the distal ends of one of the first links and one of the second links thereto while the other is angularly and displaceably connected to the distal ends of the other of the first links and the other of the second links thereto. When the body yaws laterally as well as angularly displaces relative to the bogie frame, the levers are driven into angular displacement in opposite directions such that the first and second axle boxes are angularly displaced relative to the bogie frame.

6 Claims, 15 Drawing Sheets

RAILWAY VEHICLE BOGIE

FIELD OF THE INVENTION

The present invention relates to a forcibly steered railway vehicle bogie used for a so-called bolsterless bogie.

BACKGROUND OF THE INVENTION

When the direction of wheels of a railway vehicle bogie makes an angle with rails on which the bogie is running, the wheels exert lateral depressive forces against the rails, disturbing smooth running of the bogie, particularly on a curved track. This angle is referred to as attack angle. A forcibly-steered type bogie is forcibly steered to ensure stable running of a vehicle on a linear track as well as smooth running on a curved track. The bogie is steered such that when the bogie rounds a curved track, the rotational axes of axles pivotally carrying a car body thereon intersect the radial center of the curved track to minimize the attack angle of the wheels. It has been necessary to provide forcibly-steered type bolsterless bogies having smooth turning-operation on a curved track, simplified construction, lighter weight, and easy maintenance.

OBJECT OF THE INVENTION

An object of the present invention is to provide a railway vehicle bogie having a simplified construction and being forcibly steered to smoothly round a curved track.

SUMMARY OF THE INVENTION

Front and rear axle boxes are spaced longitudinally of the bogie frame and are angularly displaceably mounted at the centers thereof to the bogie frame. The axle boxes carry a vehicle body thereon and support axles therein. First links are angularly displaceably connected to the front axle box while second links are angularly displaceably connected to the rear axle box. A pair of levers are spacedly disposed transversely of the bogie frame and angularly displaceably connected at the intermediate portions thereof to the bogie frame. One of the levers is angularly and displaceably connected the distal ends of one of the first links and one of the second links thereto while the other is angularly and displaceably connected the distal ends of the other of the first links and the other of the second links thereto. When the body yaws laterally as well as angularly displaces relative to the bogie frame, the levers are driven into angular displacement in opposite directions such that the first and second axle boxes are angularly displaced relative to the bogie frame.

BRIEF DESCRIPTION OF THE DRAWINGS

Various features and other objects of the invention will be more apparent from the following detailed description of the illustrated embodiments with reference to the accompanying drawings in which like reference characters designate like or corresponding parts throughout the several views, and wherein.

DETAILED DESCRIPTION OF THE PREFERRED EMBODIMENTS

First Embodiment

Figure 1:
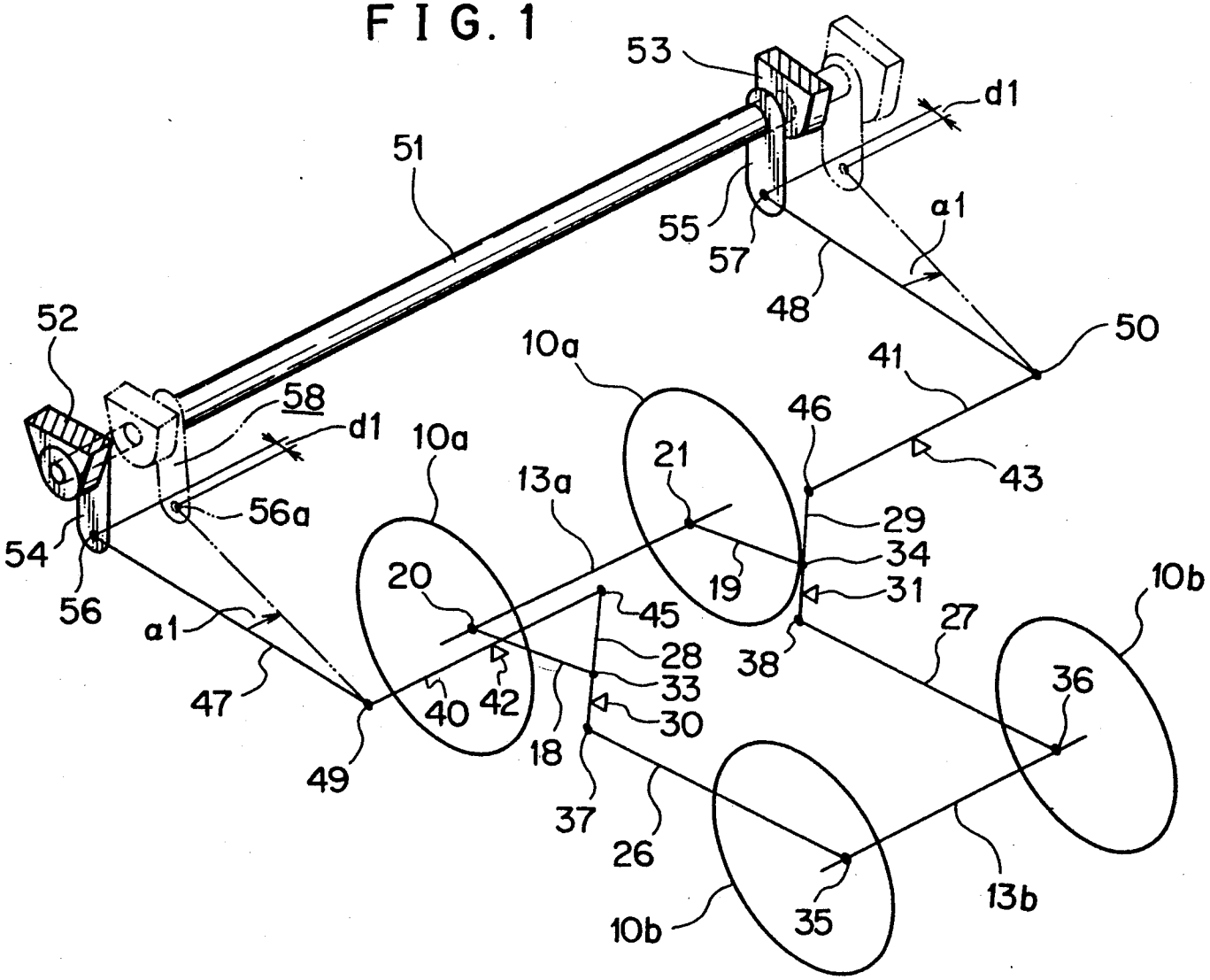
FIG. 1 is a three-dimensional view in line diagram of a first embodiment of a railway bogie according to the present invention.
Figure 2:
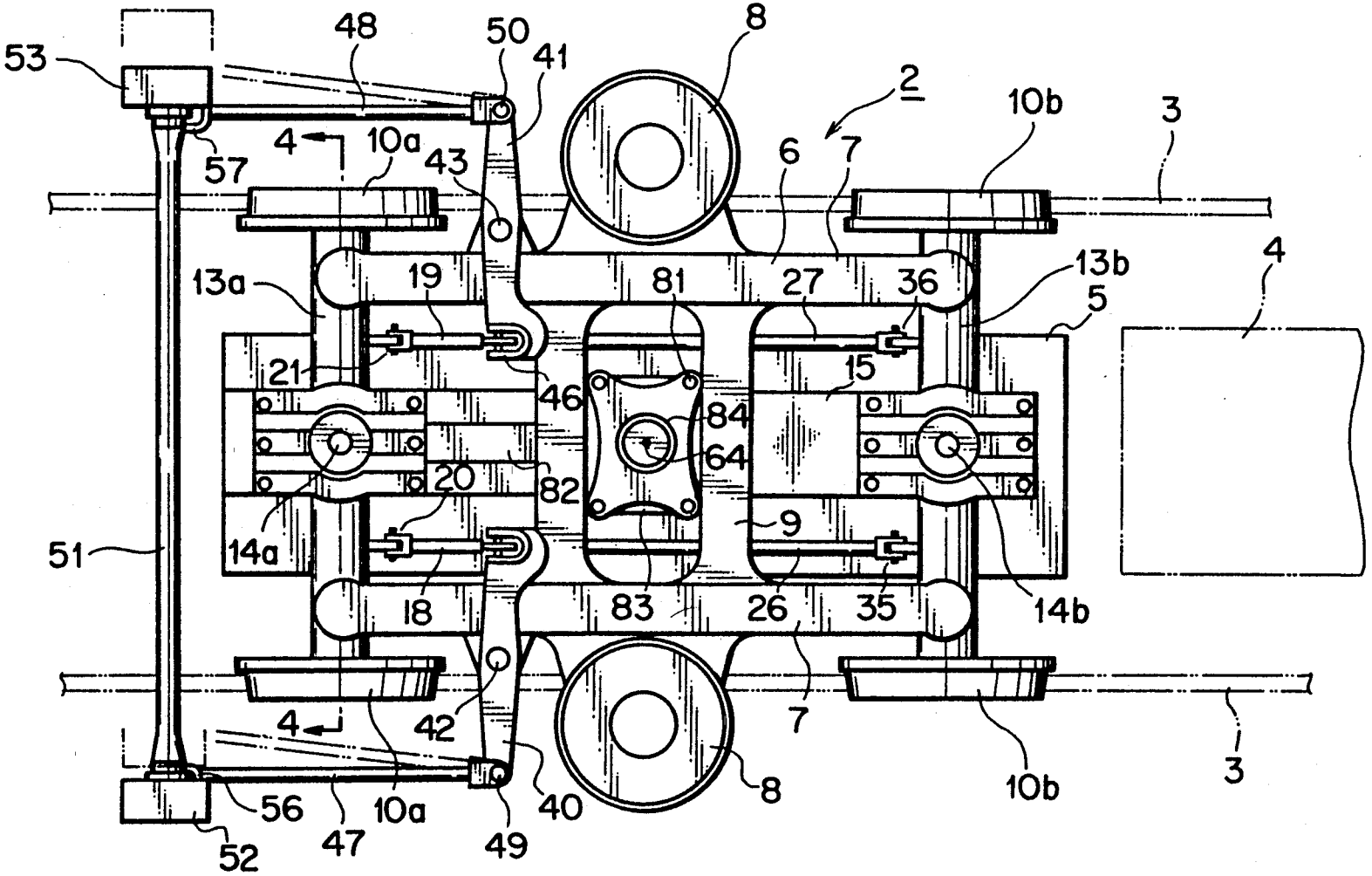
FIG. 2 is a simplified top view of the embodiment in FIG. 1.
Figure 3:
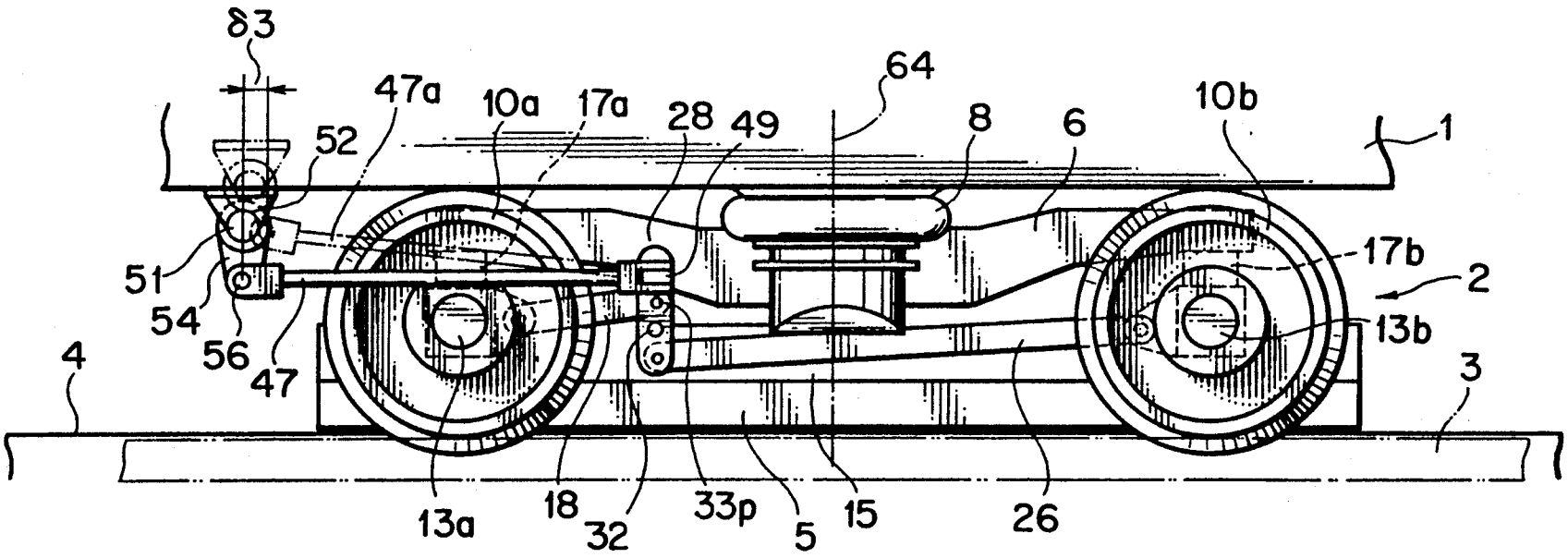
FIG. 3 is a side view of FIG. 2.
Figure 4:
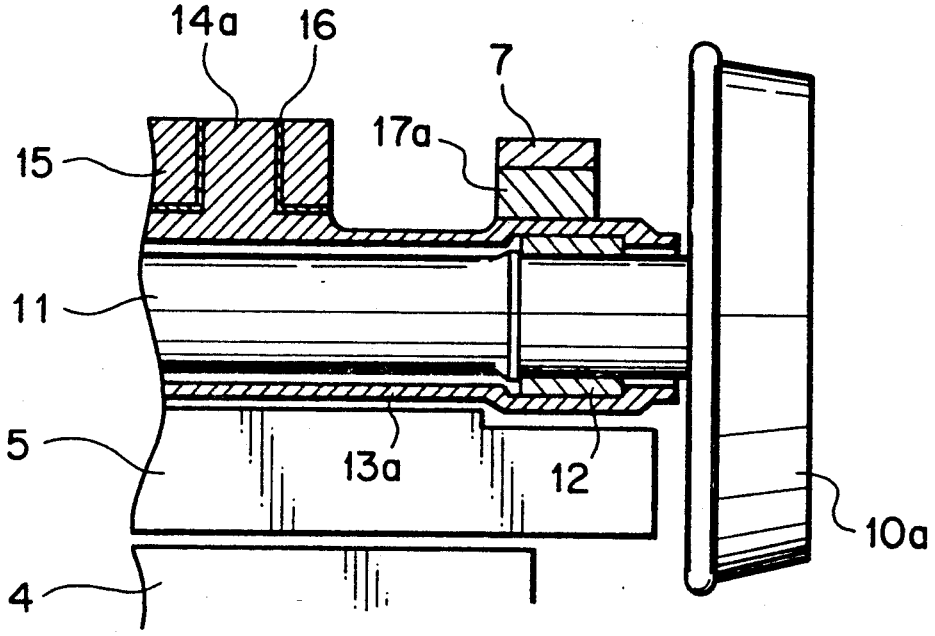
FIG. 4 is a fragmentary cross-sectional view taken along the lines 4—4 of FIG. 2.

FIG. 1 is a three-dimensional view in line diagram of a first embodiment of a railway vehicle bogie according to the present invention, FIG. 2 is a top view of the embodiment in FIG. 1, and FIG. 3 is a side view of FIG. 2. A body 1 is carried on two bogies 2, one of which being shown in the figures. A pair of rails 3 are provided along the path of the railway vehicle on the ground. Reaction plates 4 are placed between the rails 3. A coil 5 is carried on the bogie 2. The coil 5 and reaction plate 4 form a linear motor, which produces traction forces when the coil 5 opposes the reaction plate 4 as the bogie runs on the rails 3. A generally H-shaped bogie frame 6 is carried on two axle boxes and has two longitudinally extending and transversely spaced side beams 7. A pair of upright springs 8 are disposed on the middle of the side beams 7. The body 1 is carried on the bogie frame 6 by means of the springs 8. A traction force transmitting apparatus 83 is disposed on lateral beams 9 midway between the two side beams 7. The apparatus 83 has a center pin 84 and a resilient body and serves to transmit forces in the forward and rearward directions (traction forces and braking forces) while also allowing relative lateral displacement and relative angular movement between the body 1 and bogie 2. The center pin 84 has a vertical axis 64 as shown in FIG. 3 and is secured to the body 1 by means of bolts 81. The traction force generated by the coil 5 is transmitted to the body 1 through the apparatus 83 and the pin 84. FIG. 4 is a fragmentary cross-sectional view taken along the lines 4—4 of FIG. 2. An axle 11 has affixed thereto a pair of wheels 10*a* and is supported by an elongated axle box 13*a* via bearings 12. The axle box 13*a* has a projecting mandrel 14*a* at a longitudinal center thereof. The mandrel 14*a* is inserted into a hole 16 formed in a mounting base 15 to which the coil 5 is mounted. The side beams 7 are supported by the axle box 13*a* near the bearings 12 through resilient bodies 17*a* such as a pedestal plate and a rubber plate.

Wheels 10*b* are supported by an axle box 13*b* in the same manner as the wheels 10*a*. The other construction associated with the wheels 10*b* is the same as that of the wheel 10*a* and elements have the same numerals with suffix "b."

Figure 5:
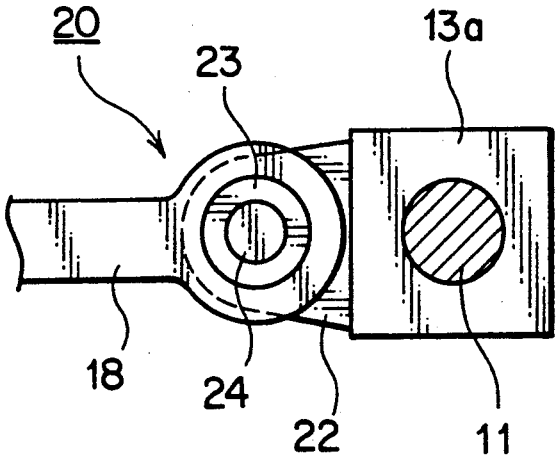
FIG. 5 is a cross-sectional view of the proximity of connections 20 through which a pair of first links 18 and 19 are connected to the axle box.
Figure 6:
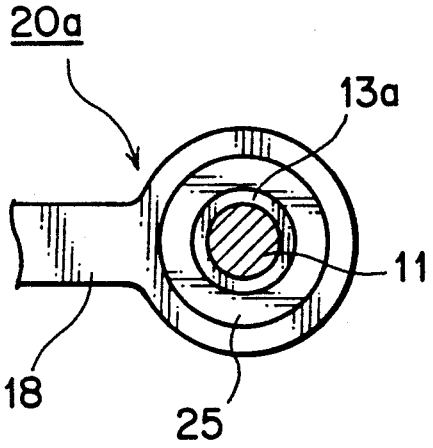
FIG. 6 is a cross-sectional view of a connection 20*a:*

FIG. 5 is a cross-sectional view of the proximity of connections 20 through which respective ends of a pair of first links 18 and 19 are connected to the axle box 13*a* near two end portions of axle 11. The first links 18 and 19 are angularly displaceably supported by means of resilient bodies 23 such as rubber or spherical bearings 23. When the bogie is not forcibly steered, the axis of a pin 24 is in parallel to the axle 11. Another connection 21 is of the same construction as the connection 20. The resilient material or spherical bearing is used so that the axle box 13*a* is given a steered displacement while allowing the angular displacement of links 18 and 19 relative to the axle box 13*a*. When a resilient material such as rubber is used for 23, its spring constant ranges from about 500 to 1000 kgf/mm, depending on required stiffness in longitudinal and transverse directions, in order to provide stable running performance of the bogie. The links 18 and 19 may be connected to the axle boxes 13*a* by the use of connection 20 shown in FIG. 3. In which case, the first link 18 is connected to the axle box 13*a* by means of a resilient material 23. A pair of second links 26 and 27 are angularly displaceably connected at respective ends thereof to another axle box 13*b* at connections 35 and 36. A pair of first levers 28 and 29 vertically extend, are spaced apart transversely of the bogie, and are angularly and displaceably connected to the two sides of bogie frame 6 as shown in FIGS. 1 and 3. The lever 28 is supported at 30 lower than the middle thereof by the bogie frame 6 by means of a pin 32 as shown in FIG. 3. Likewise, the lever 29 is supported at 31 by the bogie frame 6. One of the first links 18 is angularly displaceably connected at connection 33 to the first lever 28 by means of a pin 33*p* shown in FIG. 3 while the other first link 19 is angularly displaceably connected at connection 34 to another first lever 29. Respective ends of the second links 26 and 27 are angularly displaceably connected at connections 35 and 36 to the axle box 13*b* while the other ends are angularly displaceably connected at connections 37 and 38 to the first levers 28 and 29. Between the connections 33 and 37 is supported the first lever 28 by the bogie frame 6 and between the connections 34 and 38 is supported another first lever 29 by the bogie frame 6. Second levers 40 and 41 are angularly displaceably connected at 42 and 43 to two sides of bogie frame 6 via pins, respectively. Respective ends of the second levers 40 and 41 are angularly displaceably connected to the first levers 28 and 29 at connections 45 and 46 through, for example, spherical bearings while the other ends are angularly displaceably connected at connections 49 and 50 through, for example, spherical bearings to one ends of operating links 47 and 48. The operating links 47 and 48 are substantially horizontally disposed taking the rolling displacement of the body 1 into account. An actuating rod 51 extends transversely of the body 1 as shown in FIG. 2 and is mounted to brackets 52 and 53 secured to the body 1 such that the rod 51 is free to rotate about its longitudinal axis but is restricted in its axial movement. The actuating rod 51 is secured at two ends thereof to a pair of downwardly extending arms 54 and 55. The distal ends of the arms 54 and 55 are angularly displaceably connected at connections 56 and 57 to the operating links 47 and 48 by means of spherical bearings, respectively.

When the body 1 displaces or yaws to the position in phantom lines 58, as shown in FIG. 1, relative to the bogie while the vehicle is running on a linear track, the above described mechanism operates as follows: The second levers 40 and 41 remain stationary and the operating links 47 and 48 displace through an angle $\alpha_1$ about the connections 49 and 50 from the position in solid line to the position in phantom line, so that the arms 54 and 55 and actuating rod 51 angularly displace with respect to the connections 49 and 50. At this time, the connections 56 and 57 displace a distance d1 as depicted by a phantom line 58*a* in FIG. 1. Thus, the second levers 40 and 41 do not exert any forces due to the lateral yaw of the body 1, allowing the vehicle to run straight on the linear track.

Figure 7:
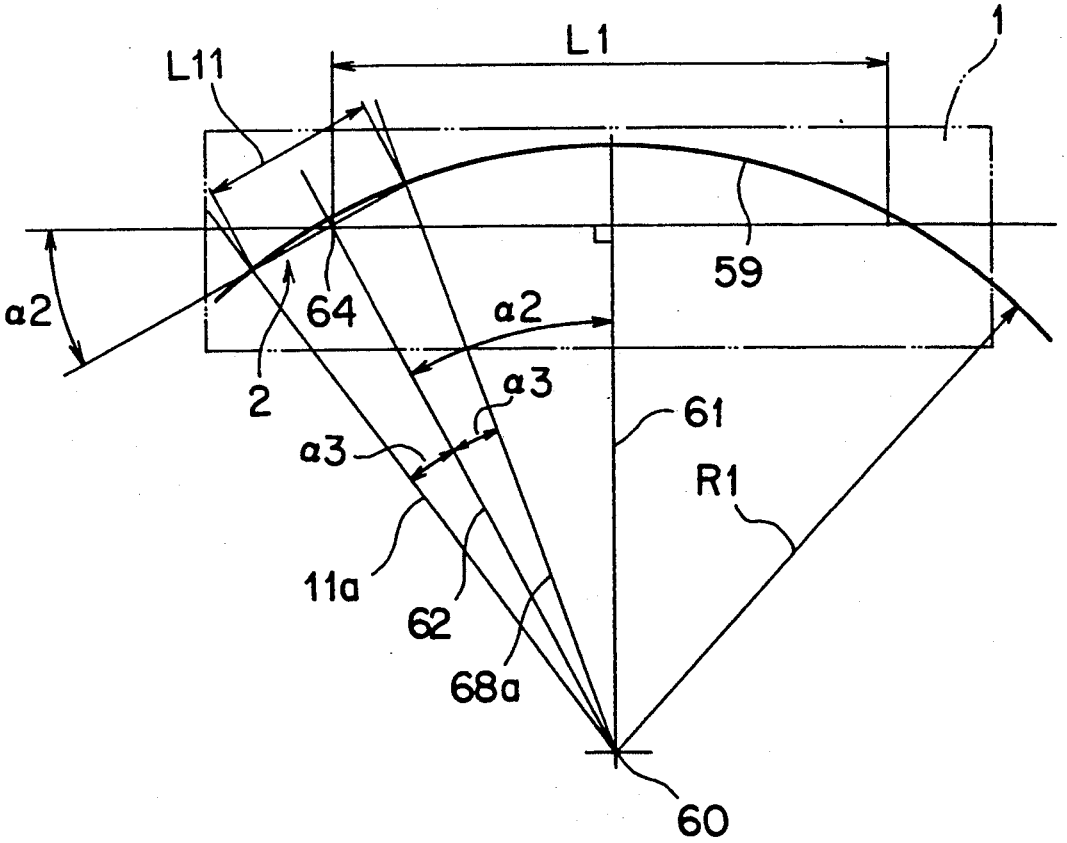
FIG. 7 is a simplified top view showing the contour of a vehicle which rounds a curved track.

If the track is circularly curved, the center between the pair of rails describes an arc 59 having a radius R1 and a center 60 as shown in FIG. 7. The body 1 is carried on two bogies 2, a front bogie and a rear bogie spaced apart a distance L1 in the advancing direction of the vehicle. The body 1 pivots about the axis 64 relative to the bogie frame 6 through an angle $\alpha_2$ which is made by a line 61 that divides the distance L1 between the center pins of the two bogies into two equal parts and a line 62 that connects the axis 64 of pin 84 and the center 60. In order for the vehicle to smoothly round a curved track, it is necessary that the extension of axis 11*a* of axle 11 intersects the straight line 62 at an angle of $\alpha_3$ near the center 60. At this time, the extension of axis 68*a* of the axle 68 also intersects the line 62 at an angle $\alpha_3$. Thus, the extension of axis 11*a* makes an angle $2\cdot\alpha_3$ with the extension of axis 68*a*.

FIG. 3 illustrates the operating link in phantom line 47*a* when the body 1 simply displaces vertically relative to the bogie frame 6. The connection 56 of operating link 47 displaces rearwards by a distance $\delta 3$. The connection 57 of operating link 48 also displaces rearwards by a distance $\delta 3$. Thus, the vertical relative movement of the body 1 and bogie frame 6 will not steer the axles 11 and 68.

Figure 8:
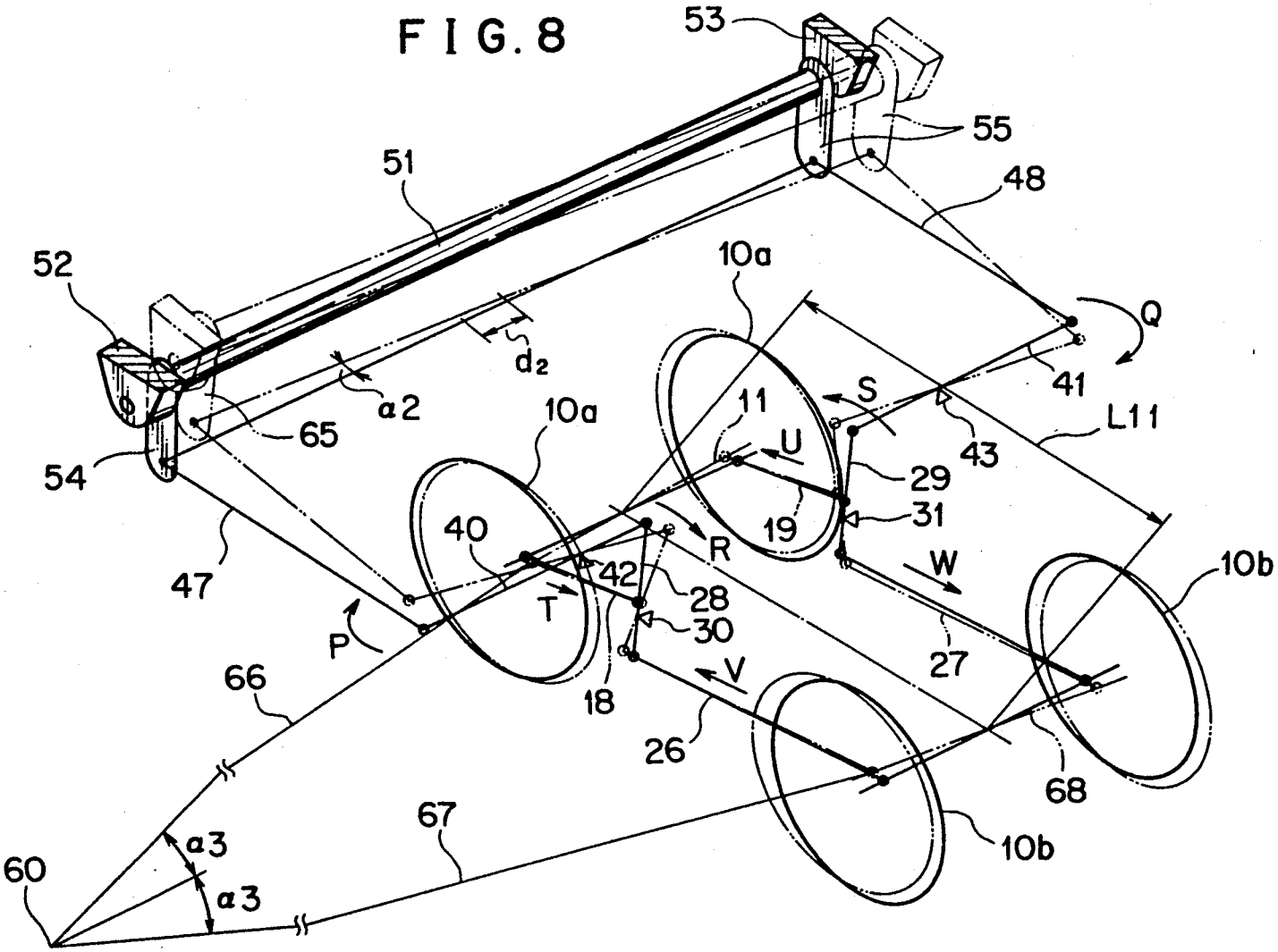
FIG. 8 illustrates the relationship between the wheels, links, operating rod, and levers of the first embodiment when the vehicle rounds a curved track.

FIG. 8 illustrates the relation between the wheels, links, actuating rod, and levers when the body 1 displaces a distance d2 laterally relative to the bogie frame 6 and rotates through an angle $\alpha_2$ relative to the bogie frame 6 about the center pin 84 while the vehicle rounds a curved track. At this time, the actuating rod 51 is positioned as depicted by a phantom line 65 in FIG. 8. The second lever 40 is driven by the operating link 47 into angular displacement about 42 in a direction P while the other second lever 41 is driven by the other operating link 48 into angular displacement about 43 in a direction of Q. Then, the first lever 28 angularly displaces about 30 in the direction of R so as to drive the first link 18 to displace in the direction of T while the other first lever 29 angularly displaces about 31 in the direction of S so as to drive the first link 19 to displace in the direction of U. This causes the axle 11 to slightly rotate counterclockwise about the projecting mandrel 14*a* to a position depicted by a phantom line. Meanwhile, the links 26 and 27 displace in the directions of V and W, respectively, so that the axle 68 slightly rotates clockwise to a position depicted by a phantom line. The resultant lever ratio of the first levers 28 and 29 and the second levers 40 and 41 is selected such that the lines 62 and 11*a* produce the angle $\alpha_3$ when the body 1 angularly displaces through the angle $\alpha_2$ relative to the bogie frame 6. In this manner, the axles 10*a* and 10*b* are steered so that the extended axes 66 and 67 of axles 11 and 68 pass through the center 60 of the curved track. At this time, a torsional torque is exerted on the actuating rod 51 but the deformation of actuating rod 51 is negligible since the rod 51 is highly rigid. Thus, the angular displacements of arms 54 and 55 are the same when the vehicle rounds a curve and relative angular displacement thereof is negligible. The above described operation minimizes the attack angle of wheels 10*a* and 10*b* relative to the rails 3 so that the rails are exerted less lateral depressive forces. This provides smooth running of the vehicle when the vehicle rounds a curved track having a small radius. No steering force is exerted on the axles 11 and 68 when the body 1 laterally and vertically displaces relative to the bogie frame 6 while the vehicle rounds a curved track. While the operation has been discussed with respect to the vehicle rounding a counterclockwise curve, the above description may be reversed when the vehicle rounds a clockwise curve.

In the first embodiment, when the body 1 moves to left and right as well as up and down relative to the bogie frame 6, the distance L11 between the centers of two axles 11 and 68 remains constant, being advantageous in simplifying the construction where the coil 5 is fixed on the axle boxes 13*a* and 13*b*. The resilient material 23 used for the connections 20 may also be used for the other connections 33, 34, 35, 36, 37, 38, 30, 31, 42, and 43, or may be used in place of the spherical bearings 45, 46, 49, and 50.

Second Embodiment

Figure 9:
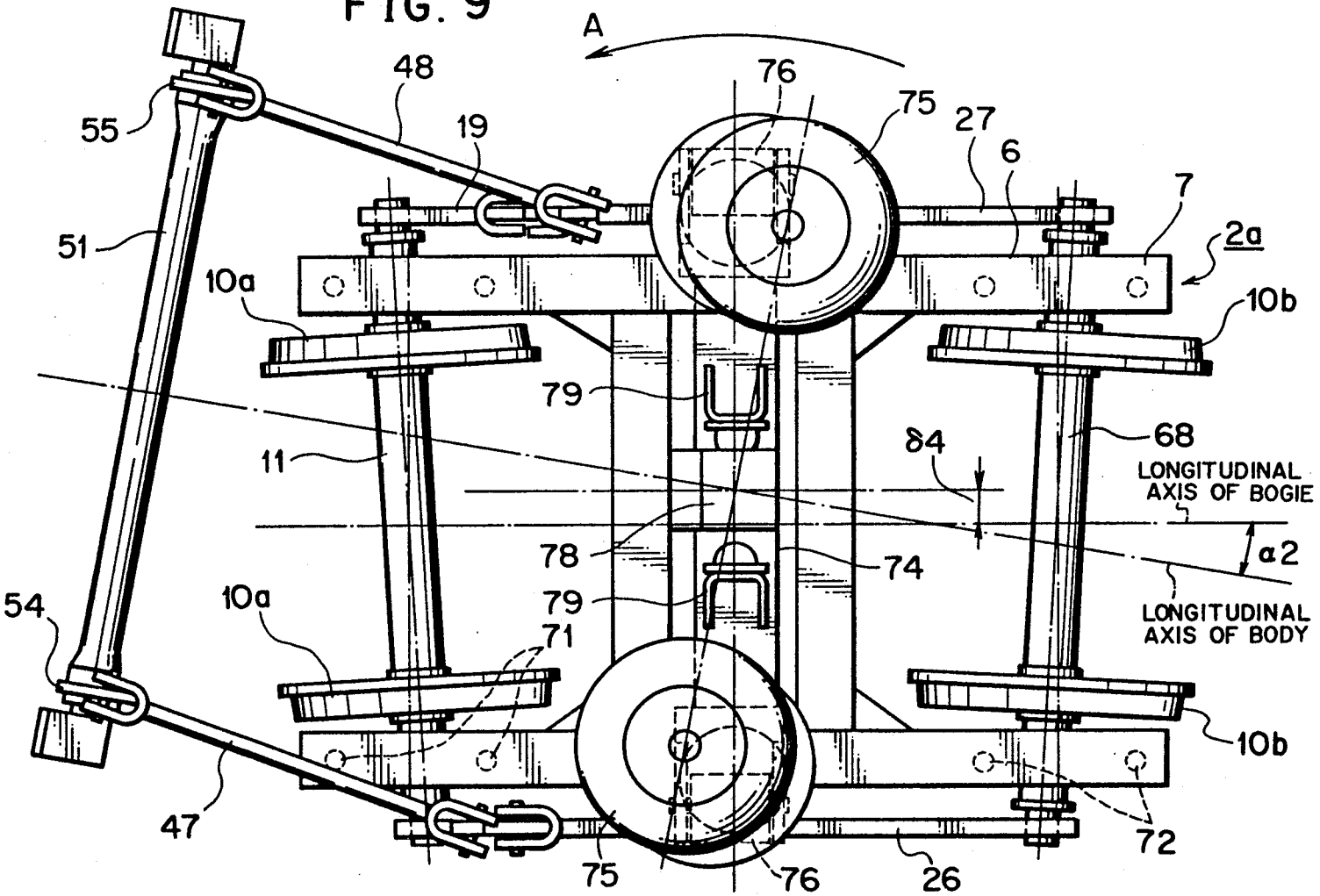
FIG. 9 shows a second embodiment of the invention and is a top view of a bogie 2*a* of a natural tilting type or a forced tilting type to which the present invention is applied.
Figure 10:
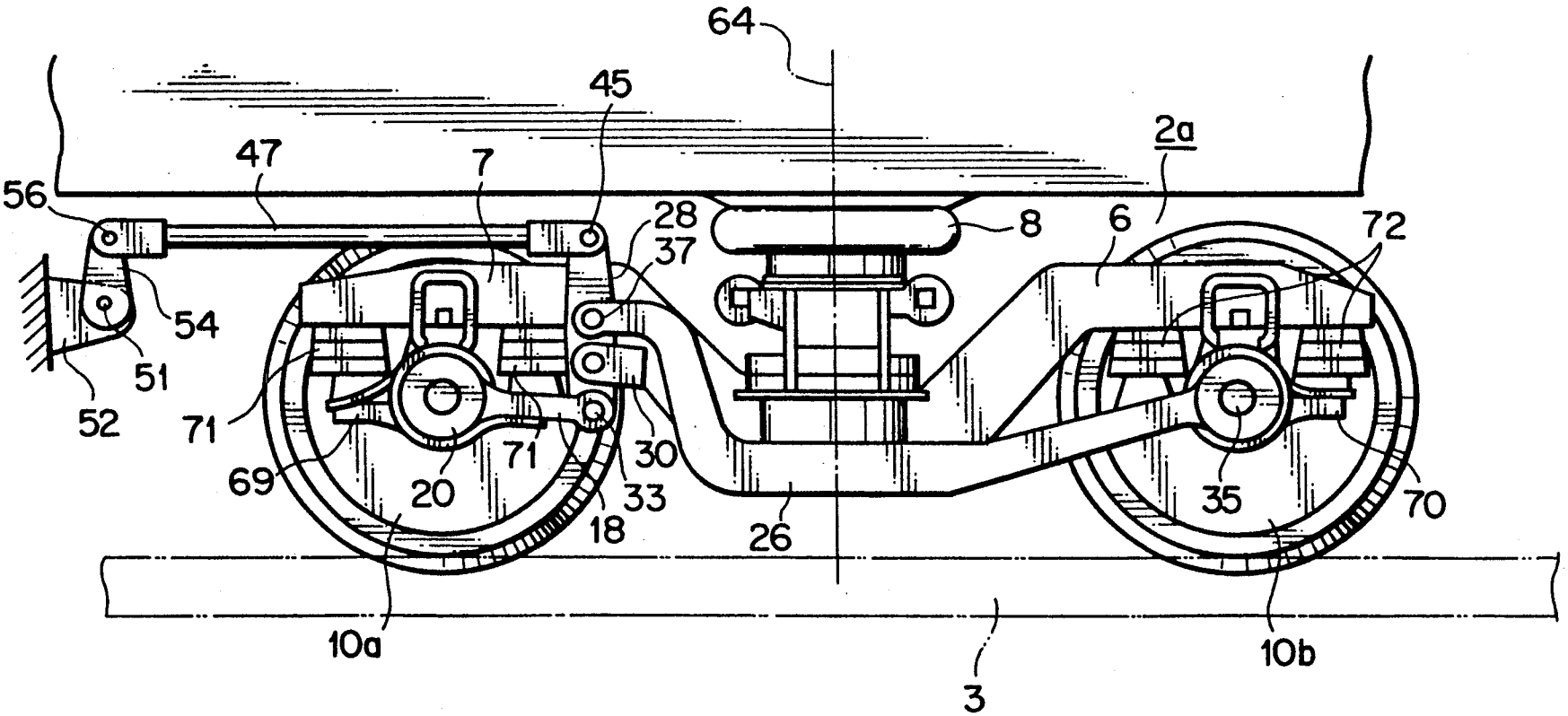
FIG. 10 is a side view of the bogie 2*a;*
Figure 11:
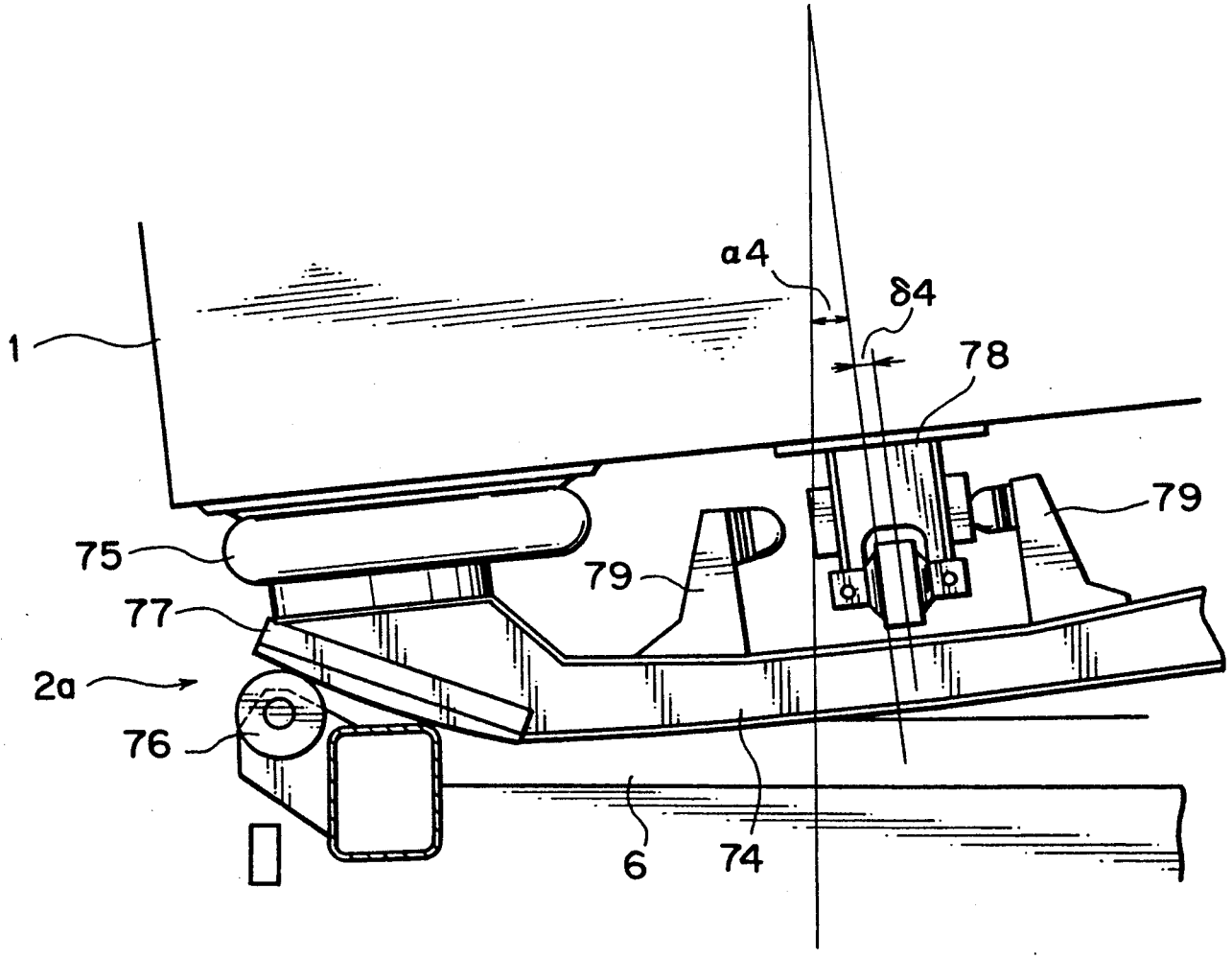
FIG. 11 is a cross-sectional view showing part of the bogie 2*a* when body 1 laterally displaces relative to the bogie frame 6 and swings like a pendulum.

FIG. 9–11 shows a second embodiment of the invention. FIG. 9 is a top view of a bogie 2*a* of a natural tilting type or a forced tilting type to which the present invention is applied. FIG. 9 illustrates the relation between the wheels, links, actuating rod, and levers when the body 1 displaces angularly and laterally relative to the bogie frame 6 and swings like a pendulum while the vehicle rounds a curved track in the direction of A. FIG. 10 is a side view of the bogie 2*a* and FIG. 11 is a cross-sectional view showing part of bogie 2*a* when the body 1 laterally displaces relative to the bogie frame 6 and swings like a pendulum. Elements corresponding to those in the first embodiment have been given the same reference numerals. Axle boxes 69 and 70 are mounted to the side beams 7 of bogie frame 6 via axle springs 71 and 72, and support axles 11 and 68. It should be noted that unlike the first embodiment, the wheels 10*a* and 10*b* are positioned between side beams 7 as shown in FIG. 9. As shown in FIG. 11, a tilting beam 74 supports the body 1 thereon by means of an air spring 75. Rotatably mounted on the bogie frame 6 are rollers 76 on which the tilting beam 7 is carried at 77. The body 1 swings within an angle $\alpha_4$ in one direction and an angle $\alpha_4$ in the other. A projection 78 projecting downwardly from the body 1 is limited its lateral displacement $\delta_4$ by stoppers 79 on the tilting beam 74. The tilting beams 74 are limited in the movements thereof by stoppers not shown. The lever 28 is angularly displaceably mounted at 30 to the bogie frame 6 and the links 26 and 18 are angularly displaceably connected above and below the connection 30. The first link 18 is connected to the axle box 69 mounted on the end portion of axle 11 and the lever 28 extends upwards to the bottom of body 1. Mounting the levers 28 and 29 at extreme ends of axle 11 is advantageous in detecting the angular displacement of the body 1 relative to the bogie frame 6 with higher sensitivity than mounting the levers closer to the longitudinal center of axles. As shown in FIG. 10, one end of the operating link 47 is angularly displaceably connected at 45 to the lever 28 while the other end is angularly displaceably connected at 56 to the arm 54.

In the first embodiment in FIG. 1, the overall lever ratio is a combined value of the lever ratios of first and second levers 28 and 40 while in the second embodiment, the lever ratio of the lever 28 alone determines the overall lever ratio. The same is true of the other lever 29. The present invention may be applied to other constructions in which the body 1 is carried on the bogie frame 6, or to bogies having bolster spring beams or yawing beams.

Third Embodiment

Figure 12:
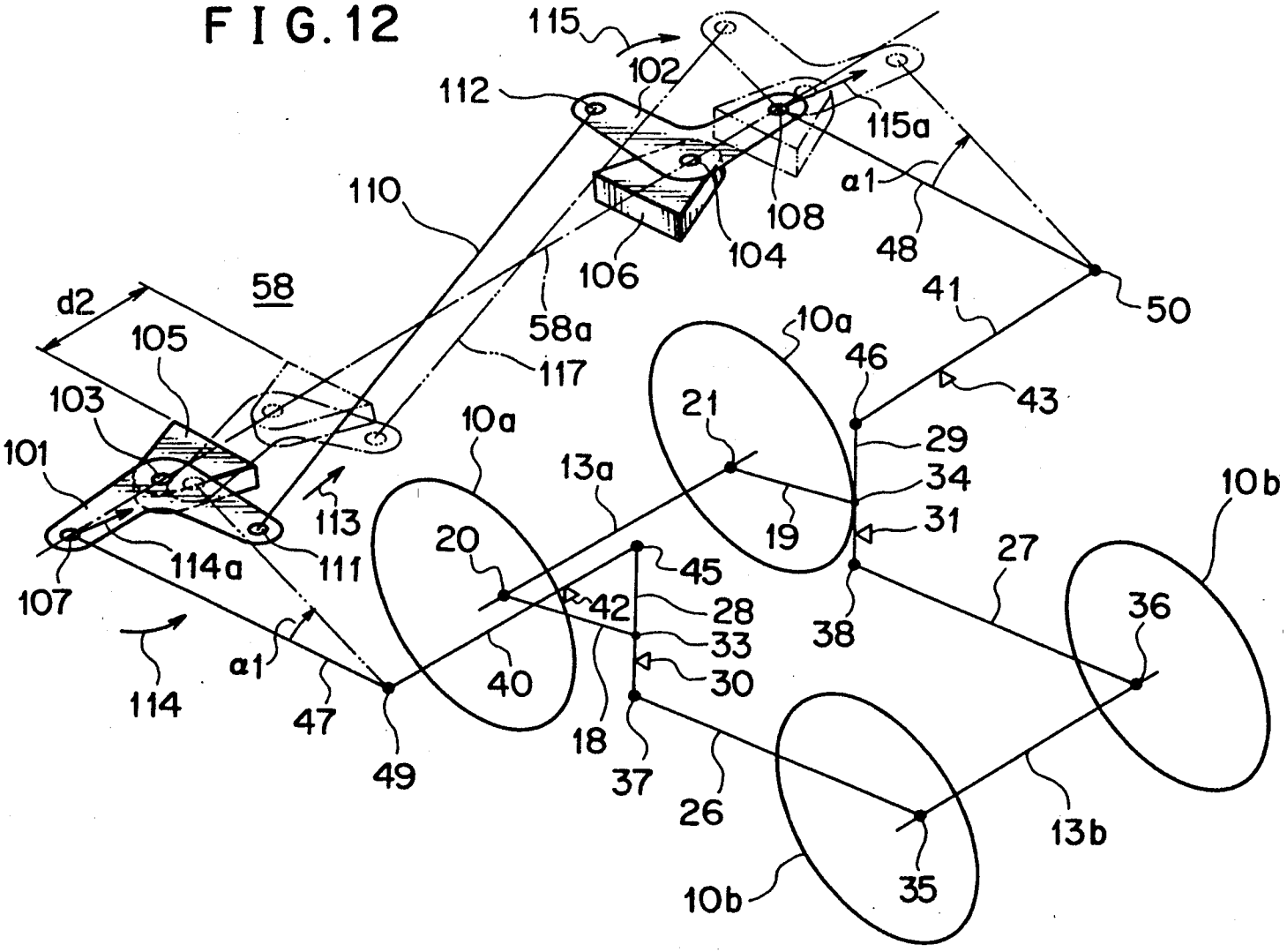
FIG. 12 is a three-dimensional view in line diagram of a third embodiment of a railway bogie according to the present invention.
Figure 13:
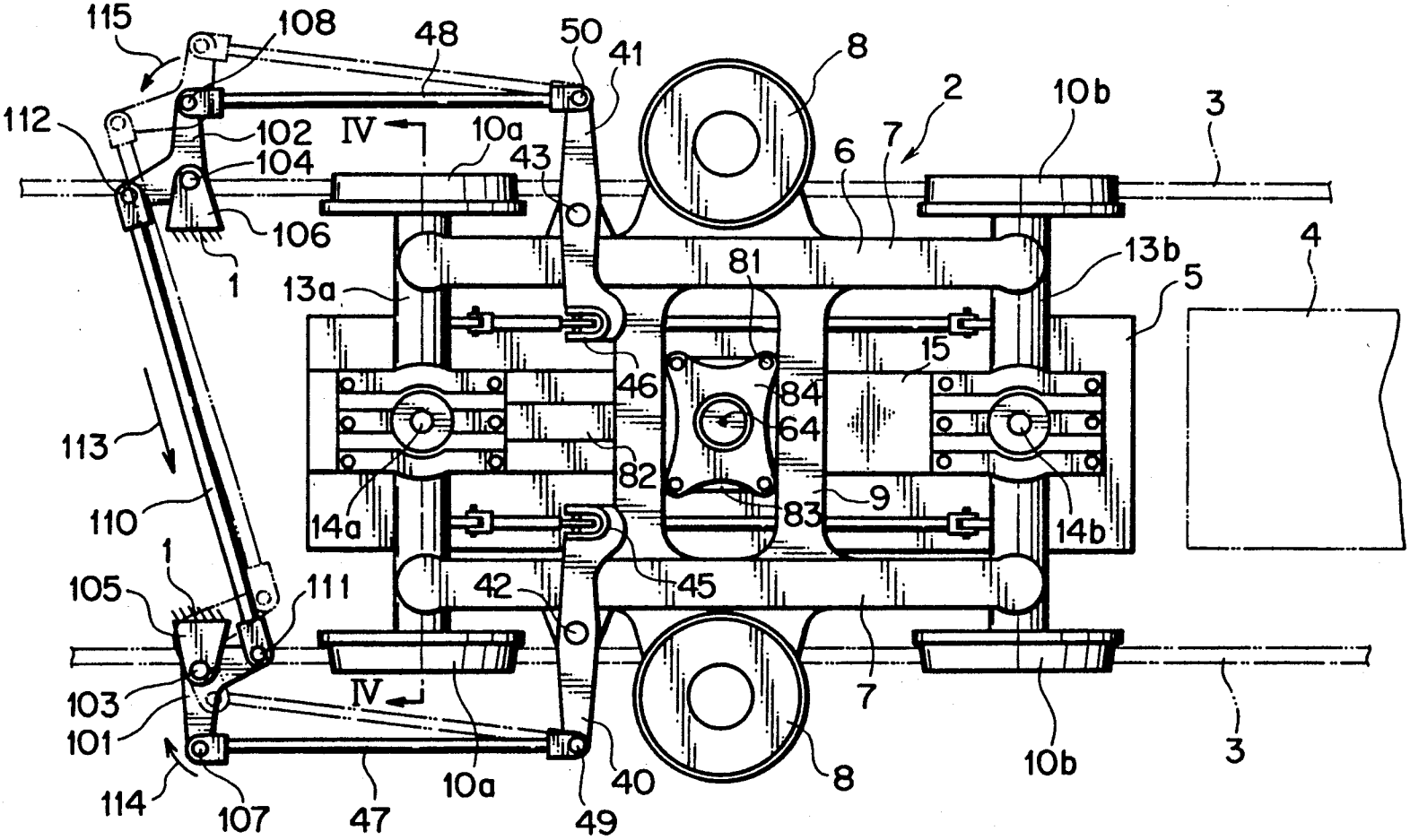
FIG. 13 is a top view of the embodiment in FIG. 12.
Figure 14:
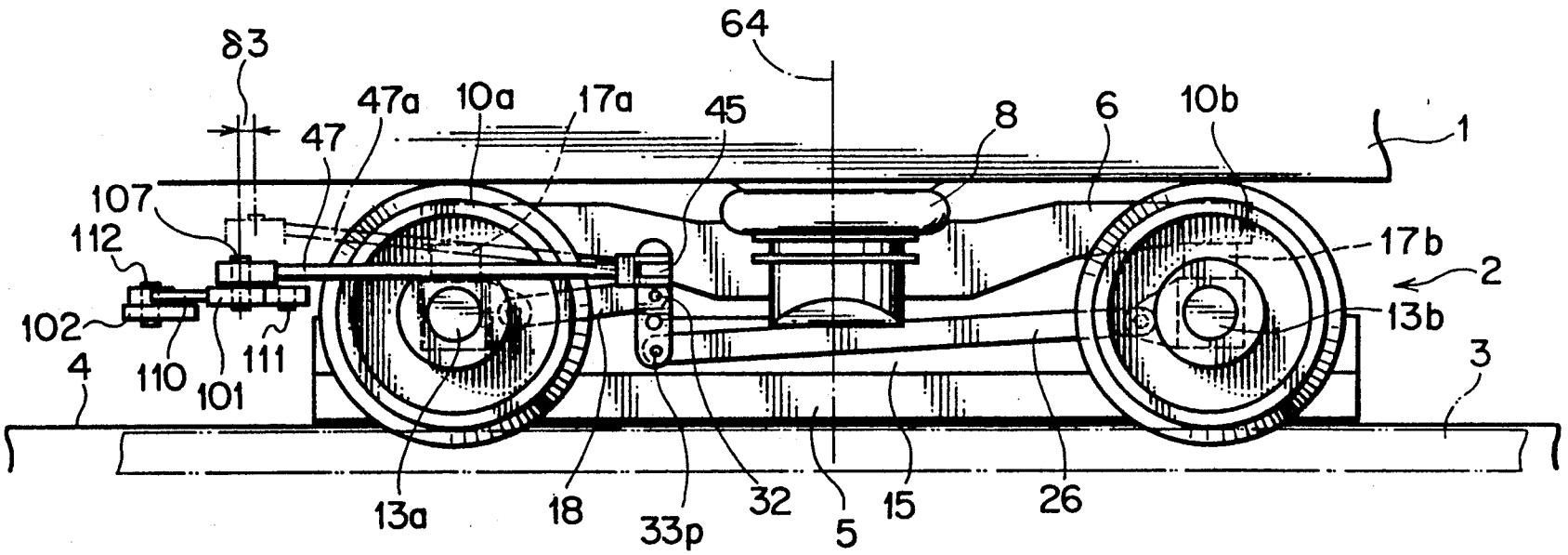
FIG. 14 is a side view of FIG. 2.

FIG. 12 is a three-dimensional view in line diagram of a third embodiment of a railway bogie according to the present invention, FIG. 13 is a top view of the embodiment in FIG. 12, and FIG. 14 is a side view of FIG. 2. Elements similar to those in the first embodiment are omitted their descriptions.

A pair of third levers 101 and 102 are so-called bellcrank levers and are supported at 103 and 104 by brackets 105 and 106 of the body 1, respectively. Respective ends of the third levers 101 and 102 are angularly displaceably connected at connections 107 and 108 to the operating links 47 and 48 while the other ends are angularly displaceably connected at connections 111 and 112 to the rigid actuating rod 110 by means of pins. The connections 107 and 108 may take the form of spherical bearings. Thus, the actuating rod 110 is angularly displaceable with respect to the third levers 101 and 102. For example, when the actuating rod 110 displaces in the direction of the arrow 113, one of the third levers 101 displaces angularly in the direction of the arrow 114 while the other lever 102 displaces in the direction of the arrow 115. That is, the actuating rod is connected to the two levers 101 and 102 such that the rotation of one lever in one direction causes the rotation of the other in the other direction.

When the body 1 displaces or yaws to the position in phantom lines 58 in FIG. 12 relative to the bogie while the vehicle is running on a linear track, the above described mechanism operates as follows: The second levers 40 and 41 remain stationary and the operating links 47 and 48 displace through an angle $\alpha_1$ about the connections 49 and 50 from the position in solid line to the position in phantom line, so that the third levers 101 and 102 displace in the direction of 114*a* and 115*a*, causing the actuating rod 110 to displace in the direction of the arrow 113. At this time, the second levers 40 and 41 remain stationary. Thus, the second levers 40 and 41 do not exert forces due to the lateral yawing of the body 1, allowing the vehicle to run straight on the linear track.

If the track is circularly curved, the center between the pair of rails 3 describes an arc 59 having a radius R1 and a center 60 as shown in FIG. 7. The body 1 is carried on two bogies 2, a front bogie and a rear bogie spaced apart a distance L1 in the advancing direction of the vehicle. The axles of wheels 10*a* and 10*b* are spaced apart by a distance L11. The body 1 pivots about the axis 64 relative to the bogie frame 6 by an angle $\alpha_2$ which is made by a line 61 that divides the distance between the center pins of the two bogies into two equal parts and a line 62 that connects the axis 64 of pin 84 and the center 60. In order for the vehicle to smoothly round a curved track, it is necessary that the extension of axis 11*a* of axle 11 intersects the straight line 62 at an angle of $\alpha_3$ near the center 60. At this time, the extension of axis 68*a* of the axle 68 also intersects the line 62 at an angle $\alpha_3$. Thus, the extension of axis 11*a* makes an angle $2 \cdot \alpha_3$ with the extension of axis 68*a*.

Figure 15:
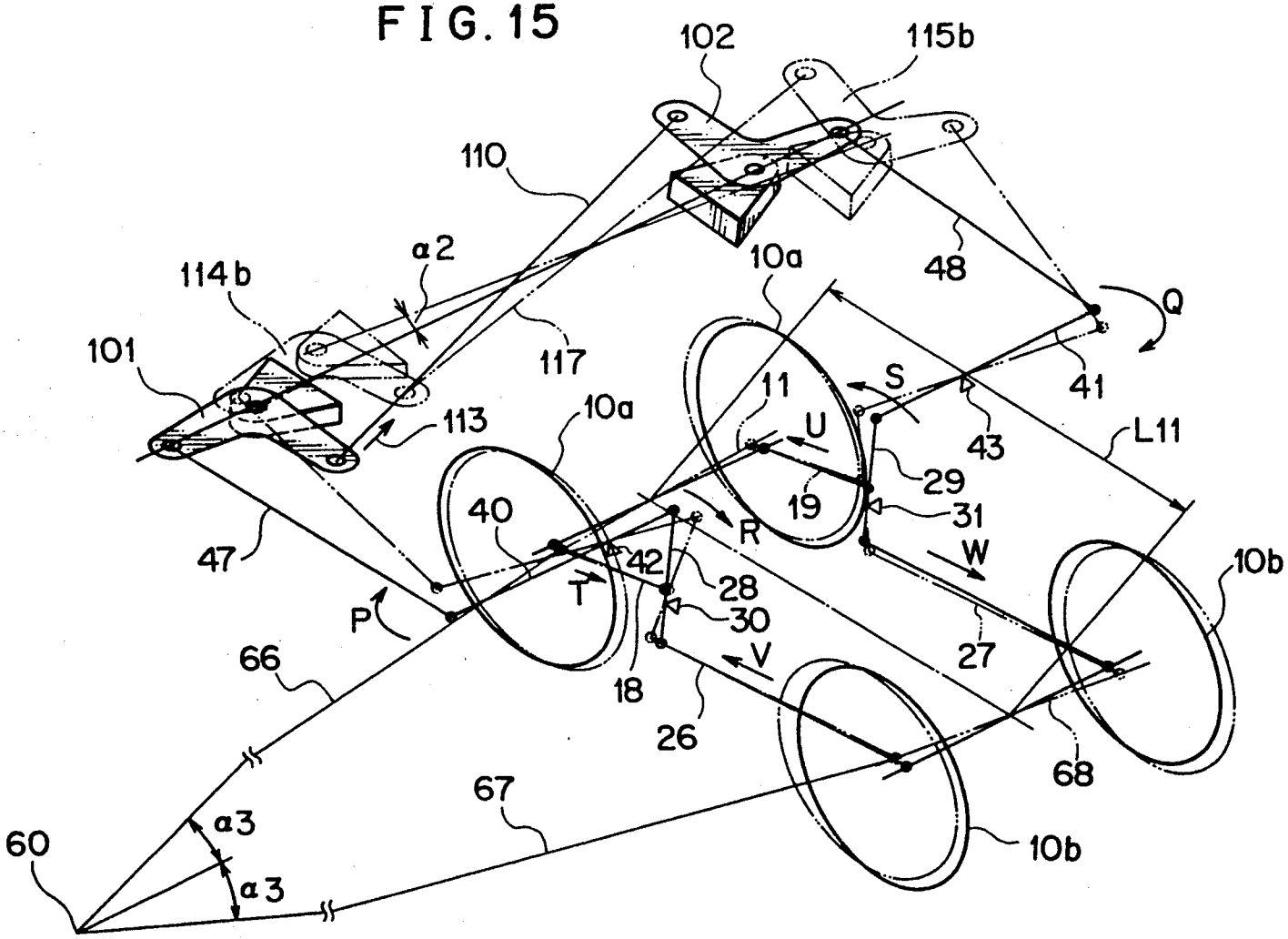
FIG. 15 illustrates the relation between the wheels, links, operating rod, and levers of the third embodiment when the vehicle rounds a curved track.

FIG. 15 illustrates the relation between the wheels, links, actuating rod, and levers when the body 1 displaces a distance d2 laterally relative to the bogie frame 6 and rotates through an angle $\alpha_2$ relative to the bogie frame about the center pin 84 while the vehicle rounds a curved track. At this time, the actuating rod 110 is positioned as depicted by a phantom line 117 in FIG. 15.

The second lever 40 is driven by the operating link 47 into angular displacement about 42 in a direction of P so as to cause the first lever 28 to angularly displace about 30 in a direction of R, while the other second lever 41 is driven by the other operating link 48 into angular displacement about 43 in a direction of Q so as to cause another first lever 29 to angularly displace about 31 in a direction of S. Then, the first levers 28 and 29 drive the first links 18 and 19 to displace in directions of T and U, respectively, so that the axle 11 rotates slightly counterclockwise about the projecting mandrel 14*a* to a position depicted by a phantom line. Meanwhile, the first levers 28 and 29 also drive the second links 26 and 27 to displace in directions of V and W, respectively, so that the axle 68 rotates slightly clockwise about the projecting mandrel 14*a* to a position depicted by a phantom line.

When the body 1 displaces laterally relative to the bogie frame 6 and rotates through an angle relative to the bogie frame so that the body 1 moves from solid line position to phantom line position in FIG. 15, the actuating rod 110 displaces in the direction of arrow 113 and the third levers 101 and 102 displace to positions depicted by 114*b* and 115*b*. The actuating rod 110 is not deformed since it has a large stiffness. Thus, the angular displacements of the third levers 101 and 102 are the same. The resultant lever ratio of the first levers 28 and 29 and the second levers 40 and 41 is selected such that the angle $\alpha_3$ made by the lines 62 and 11*a* is achieved when the body 1 angularly displaces through the angle $\alpha_2$ relative to the bogie frame 6. In this manner, the axles of wheels 10*a* and 10*b* are steered so that the extended axes 66 and 67 of axles 11 and 68 pass through the center 60 of the curved track. The above described operation minimizes the attack angle of wheels 10*a* and 10*b* relative to the rails 3 so that the rails 3 have less lateral depressive forces exerted thereon. This provides smooth running of the vehicle when the vehicle rounds a curved track having a small radius. No steering force is exerted on the axles 11 and 68 when the body 1 displaces relative to the bogie frame 6 laterally and vertically while the vehicle rounds a curved track. While the operation has been discussed with respect to the vehicle rounding a counterclockwise curve, the above description may be reversed when the vehicle rounds a clockwise curve.

FIG. 14 illustrates the operating link in phantom line 47*a* when the body 1 simply displaces vertically relative to the bogie frame 6. The connection 107 of operating link 47 displaces rearwards by a distance $\delta_3$. The connection 57 of operating link 48 also displaces rearwards by a distance $\delta_3$. Thus, the vertical relative movement of the body 1 and bogie frame 6 will not steer the axle 11.

When the body 1 moves to left and right as well as up and down relative to the bogie frame 6, the distance L11 between the centers of two axles 11 and 68 remains constant, being advantageous in simplifying the construction where the coil 5 is fixed on the axle boxes 13*a* and 13*b*. The resilient material 23 used for the connections 20 may also be used for the other connections 33, 34, 35, 36, 37, 38, 30, 31, 42, and 43, or may be used in place of the spherical bearings 45, 46, 49, and 50.

Fourth Embodiment

Figure 16:
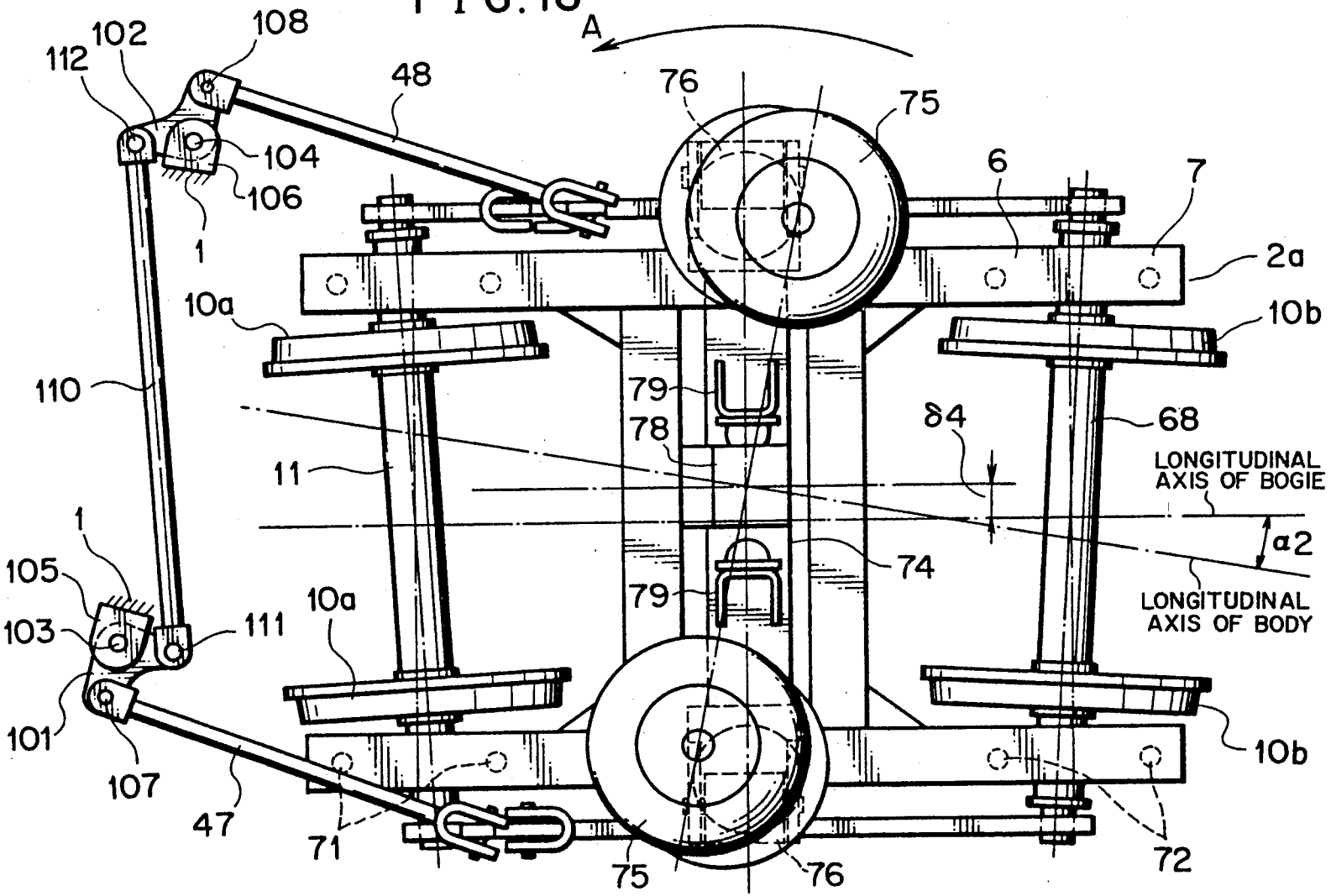
FIG. 16 is a top view of a bogie 2*a* of a fourth embodiment.
Figure 17:
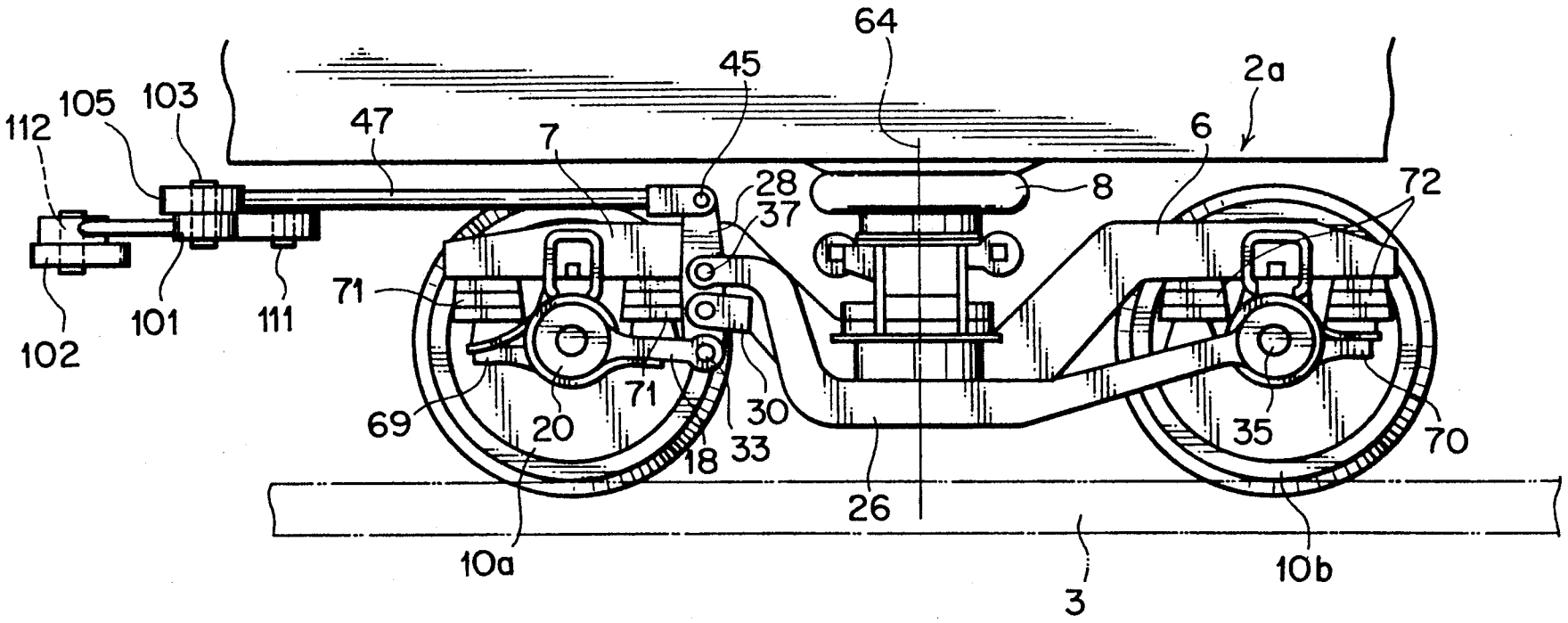
FIG. 17 is a side view of the bogie 2*a* of FIG. 16.

FIG. 16–17 shows a fourth embodiment of the invention. FIG. 16 is a top view of a bogie 2*a* of a natural tilting type or a forced tilting type to which the present invention is applied. FIG. 16 illustrates the relation between the wheels, links, actuating rod, and levers when the body 1 displaces angularly and laterally relative to the bogie frame 6 and swings like a pendulum while the vehicle rounds a curved track in a direction of A. FIG. 17 is a side view of the bogie 2*a* of FIG. 16. The cross-sectional view of the fourth embodiment is shown in FIG. 7 where part of bogie 2*a* is shown when body 1 laterally displaces relative to the bogie frame 6 and swings like a pendulum. Elements corresponding to those in the third embodiment have been given the same reference numerals. Axle boxes 69 and 70 are mounted to the side beams 7 of bogie frame 6 by means of axle springs 71 and 72, and the axle boxes support axles 11 and 68. It should be noted that unlike the third embodiment, the wheels 10*a* and 10*b* are positioned between side beams 7 as shown in FIG. 16. As shown in FIG. 11, a tilting beam 74 supports the body 1 by means of an air spring 75. Rotatably mounted on the bogie frame 6 are rollers 76 on which the tilting beam 7 is carried at 77. The body 1 swings within an angle $\alpha_4$ in one direction and an angle $\alpha_4$ in the other. A projection 78 projecting downwardly from the body 1 is limited its lateral displacement $\delta_4$ by stoppers 79 on the tilting beams 74. The tilting beams 74 are limited in the movements thereof by other stoppers not shown. The lever 28 is angularly displaceably mounted at 30 to the bogie frame 6 and the links 26 and 18 are angularly displaceably connected above and below the connection 30. The first link 18 is connected to the axle box 69 mounted on the end portion of axle 11 and the lever 28 extends upwards to the bottom of body 1 as shown in FIG. 17. Mounting the levers 28 and 29 at extreme ends of axles is advantageous in detecting the angular displacement of the body 1 relative to the bogie frame 6 with higher sensitivity than mounting the levers close to the longitudinal center of axles. One end of the operating link 47 is angularly displaceably connected at 45 to the lever 28 while the other end is angularly displaceably connected at 107 to the third lever 101.

In the third embodiment in FIG. 12, the overall lever ratio is a combined value of the lever ratios of first and second levers 28 and 40 while in the second embodiment, the lever ratio of the lever 28 alone determines the overall lever ratio. The same is true of the other lever 29. The present invention may be applied to other constructions in which the body 1 is carried on the bogie frame 6, or to bogies having bolster beams or yawing beams.

Obviously, many modifications and variations of the present invention are possible in light of the above teachings. It is therefore to be understood that within the scope of the appended claims, the present invention may be practiced otherwise than as specifically described herein.

What is claimed is:

1. A railway vehicle bogie, comprising:

a first axle box and a second axle box spaced apart longitudinally with respect to a bogie frame carrying a body thereon, each of said axle boxes holding an axle supporting wheels for movement along railway rails;

a pair of first links, each of which has a first end and a second end, said first links being spaced apart and angularly displaceably connected at said first ends to said first axle box;

a pair of second links, each of which has a third end and a fourth end, said second links being spaced apart and angularly displaceably connected at said third ends to said second axle box;

a pair of first levers spaced apart transversely with respect to said bogie frame and pivotably movable within first and second parallel planes, each of which has a fifth end, a sixth end, a first intermediate portion adjacent to said fifth end, and a second intermediate portion adjacent to said sixth end, said second intermediate portions of said first levers being angularly displaceably connected to said second ends of said first links, said fifth ends of said first levers being angularly displaceably connected to said fourth ends of said second links, and said first intermediate portions of said first levers being angularly displaceably supported by said bogie frame; and means respectively pivotably mounted upon opposite sides of said vehicle body and connected to said sixth ends of said transversely spaced pair of first levers so as to be disposed transversely outwardly with respect to said planes of said transversely spaced pair of first levers and additionally interconnect said sixth ends of said transversely spaced pair of first levers for permitting lateral and vertical movement of said vehicle body relative to said bogie frame without incurring resultant movement of said first levers, said first and second links, and said first and second axle boxes, and for angularly moving said first levers in opposite directions with respect to each other so as to in turn move said first and second links in opposite directions in order to angularly move said first and second axle boxes relative to said bogie frame so as to reduce the attack angle of said wheels with respect to said rails when said vehicle body displaces angularly relative to said bogie frame.

2. A railway vehicle bogie according to claim 1, wherein said pivotably mounted means comprises:

a pair of operating links, each of which has a seventh end and an eighth end;

a pair of second levers spaced apart transversely of the bogie frame, each of which has a ninth end, a tenth end, and a third intermediate portion and being angularly displaceably supported at said third intermediate portion by the bogie frame, said ninth ends being angularly displaceably connected to said sixth ends of said first lever and said tenth ends being angularly displaceably connected to said seventh ends of said operating links;

an actuating rod having two end portions and extending substantially transversely of the body, said actuating rod being rotatably supported at said two end portions and being restricted in its axial movement thereof relative to the body; and a pair of arms, each of which is securely connected at said end portion of said actuating rod and being angularly displaceably connected at a distal end thereof to said eighth end of said operating link.

3. A railway vehicle bogie according to claim 1, wherein said pivotably mounted means comprises:

a pair of operating links, each of which has a seventh end and an eighth end;

a pair of second levers spaced apart transversely of the bogie frame, each of which has a ninth end, a tenth end, and a third intermediate portion and being angularly displaceably connected to said third intermediate portion to the bogie frame, said ninth ends being angularly displaceably connected to said sixth ends of said first levers and said tenth ends being angularly displaceably connected to said seventh ends of said operating links;

a pair of third levers spaced apart transversely of the bogie frame, each of which has an eleventh end, a twelfth end, and a fourth intermediate portion and being angularly displaceably connected at said fourth intermediate portion to the body, said eleventh ends being angularly displaceably connected to said eighth ends of said operating links; and an actuating rod having two ends and being angularly displaceably connected at said two ends to said twelfth ends of said third levers such that an angular displacement of one of said third levers in one direction causes an angular displacement of the bogie frame in the other direction;

wherein said pair of first levers are driven at said sixth ends to angularly displace in opposite directions so as to drive said first and second axle boxes into angular displacement relative to the bogie frame when the body displaces angularly relative to the bogie frame.

4. A railway vehicle bogie, comprising:

a first axle box and a second axle box spaced apart longitudinally with respect to a bogie frame carrying a vehicle body thereon, each of said axle boxes holding an axle supporting wheels for movement along railway rails;

a pair of first links, each of which has a first end and a second end, said first links being spaced apart and being angularly displaceably connected at said first ends to said first axle box;

a pair of second links, each of which has a third end and a fourth end, said second links being spaced apart and angularly displaceably connected at said third ends to said second axle box;

a pair of first levers spaced apart transversely with respect to said bogie frame and pivotably movable within first and second parallel planes, each of which has a fifth end, a sixth end, a first intermediate portion adjacent to said fifth end, and a second intermediate portion adjacent to said sixth end, said fifth ends being angularly displaceably connected to said second ends of said first links, said second intermediate portions being angularly displaceably connected to said fourth ends of said second links, said first intermediate portions being angularly displaceably supported by said bogie frame; and means respectively pivotably mounted upon opposite sides of said vehicle body and connected to said sixth ends of said transversely spaced pair of first levers so as to be disposed transversely outwardly with respect to said planes of said transversely spaced pair of first levers and additionally interconnect said sixth ends of said transversely spaced pair of first levers for permitting lateral and vertical movement of said vehicle body relative to said bogie frame without incurring resultant movement of said first levers, said first and second links, and said first and second axle boxes, and for angularly moving said first levers in opposite directions with respect to each other so as to in turn move said first and second links in opposite directions in order to angularly move said first and second axle boxes relative to said bogie frame so as to reduce the attack angle of said wheels with respect to said rails when said vehicle body displaces angularly relative to said bogie frame.

5. A railway vehicle bogie according to claim 4, wherein said pivotably mounted means comprises:

a pair of operating links, each of which has a seventh end and an eighth end, said seventh ends being angularly displaceably connected to said sixth ends of said first levers;

an actuating rod having two end portions and extending substantially transversely of the body, said actuating rod being rotatably supported at said two end portions and being restricted in its axial movement thereof relative to the body; and a pair of arms, each of which is securely connected to one of said end portions of said actuating rod and being angularly displaceably connected at a distal end thereof to said eighth ends of said operating links.

6. A railway vehicle bogie according to claim 4, wherein said pivotably mounted means comprises:

a pair of operating links, each of which has a seventh end and an eighth end, said seventh ends being angularly displaceably connected to said sixth ends of said first levers;

a pair of second levers spaced apart transversely of the bogie frame, each of which has a ninth end, a tenth end, and a second intermediate portion and being angularly displaceably connected at said second intermediate portion to the body, said ninth ends being angularly displaceably connected to said eighth ends of said operating links; and an actuating rod having two ends angularly displaceably connected to said tenth ends of said second levers such that an angular displacement of one of said second levers in one direction causes an angular displacement of the other in the other direction.

* * * * *